US011981461B2

(12) United States Patent
Rivola et al.

(10) Patent No.: US 11,981,461 B2
(45) Date of Patent: May 14, 2024

(54) MACHINE FOR FORMING BAGS WITH INFUSION OR EXTRACTION PRODUCTS

(71) Applicant: I.M.A. INDUSTRIA MACCHINE AUTOMATICHE S.P.A., Ozzano Dell'Emilia (IT)

(72) Inventors: Sauro Rivola, Ozzano Dell'Emilia (IT); Marco Petrillo, Ozzano Dell'Emilia (IT)

(73) Assignee: I.M.A. INDUSTRIA MACCHINE AUTOMATICHE S.P.A., Ozzano Dell'Emilia (IT)

( * ) Notice: Subject to any disclaimer, the term of this patent is extended or adjusted under 35 U.S.C. 154(b) by 0 days.

(21) Appl. No.: 18/006,694

(22) PCT Filed: Jul. 28, 2021

(86) PCT No.: PCT/IB2021/056844
§ 371 (c)(1),
(2) Date: Jan. 24, 2023

(87) PCT Pub. No.: WO2022/034415
PCT Pub. Date: Feb. 17, 2022

(65) Prior Publication Data

US 2023/0264840 A1 Aug. 24, 2023

(30) Foreign Application Priority Data

Aug. 10, 2020 (IT) ..... 102020000019855

(51) Int. Cl.
*B65B 1/02* (2006.01)
*B65B 1/06* (2006.01)
(Continued)

(52) U.S. Cl.
CPC ..... *B65B 1/02* (2013.01); *B65B 1/06* (2013.01); *B65B 1/32* (2013.01); *B65B 1/36* (2013.01);
(Continued)

(58) Field of Classification Search
None
See application file for complete search history.

(56) References Cited

U.S. PATENT DOCUMENTS 2,649,674 A * 8/1953 Bartelt ..... B65B 59/00 383/37
2,885,846 A * 5/1959 Harker ..... B65B 1/24 53/562
(Continued)

FOREIGN PATENT DOCUMENTS

DE 102011051603 A1 1/2013
EP 0685391 A1 * 12/1995 ..... B65B 1/02
(Continued)

OTHER PUBLICATIONS

International Search Report and Written Opinion dated Oct. 8, 2021 from counterpart International Patent Application No. PCT/IB2021/056844.

*Primary Examiner* — Tanzim Imam
(74) *Attorney, Agent, or Firm* — SHUTTLEWORTH & INGERSOLL, PLC; Timothy J. Klima

(57) ABSTRACT

A machine for forming bags with infusion or extraction products includes a station for forming and feeding single sheets; a U-shaped folding station for folding the sheet; a unit for sealing the two lateral edges the sheet to create a bag with a closed bottom and side and an open end opposite the bottom. A second carousel includes radial grippers each configured to receive a bag. A dosing station includes a first device for dosing a first product along a dosing trajectory towards the opening and a second dosing device for dosing
(Continued)

a second product. A transporting element positioned between the dosing devices includes a container for receiving the second product. The transporting element moves the container from a second product dosing position to a position for unloading the second product coinciding with the dosing trajectory from where the container discharges the dose of the second product into the bag.

10 Claims, 4 Drawing Sheets

(51) Int. Cl.

| | |
|---|---|
| ***B65B 1/32*** | (2006.01) |
| ***B65B 1/36*** | (2006.01) |
| ***B65B 31/02*** | (2006.01) |
| ***B65B 43/02*** | (2006.01) |
| ***B65B 43/46*** | (2006.01) |

(52) U.S. Cl.
CPC ..... *B65B 31/024* (2013.01); *B65B 43/02* (2013.01); *B65B 43/465* (2013.01)

(56) References Cited

U.S. PATENT DOCUMENTS

| | | | | |
|---|---|---|---|---|
| 3,382,644 | A * | 5/1968 | Vogt | B65B 1/02 53/562 |
| 11,427,360 | B2 * | 8/2022 | Draghetti | B29C 66/133 |
| 2009/0056281 | A1 * | 3/2009 | Murray | B65D 75/5883 493/267 |
| 2012/0151874 | A1 * | 6/2012 | Solano | B65B 43/04 53/268 |
| 2020/0249064 | A1 | 8/2020 | Iwasaki et al. | |

FOREIGN PATENT DOCUMENTS

| | | | |
|---|---|---|---|
| EP | 2465781 | A1 | 6/2012 |
| WO | 2012117308 | A1 | 9/2012 |
| WO | 2017025275 | A1 | 2/2017 |
| WO | 2018162998 | A1 | 9/2018 |
| WO | 2019237131 | A1 | 12/2019 |

* cited by examiner

MACHINE FOR FORMING BAGS WITH INFUSION OR EXTRACTION PRODUCTS

This application is the National Phase of International Application PCT/162021/056844 filed Jul. 28, 2021 which designated the U.S.

This application claims priority to Italian Patent Application No. 102020000019855 filed Aug. 10, 2020, which applications are incorporated by reference herein.

TECHNICAL FIELD

This invention relates to a machine for forming bags with infusion or extraction products.

BACKGROUND ART

The type of bag according to the invention is obtained from a sheet of material obtained from metal films, such as, for example, aluminium, but the material which can be used may be different even though with features similar to metal films.

Individual powder or granular products, or composite mixtures of a main basic product and a secondary product such as, for example, an aromatising product, are inserted in this bag.

Each bag has a quadrangular shape and is closed by three seals, two lateral and one at the top, whilst the bottom is created by folding the sheet in a "U" shape and has a partly embedded shape.

These bags usually have a lateral line of weakness close to the top sealing to allow the pull-off opening of the bag.

To obtain this type of bag, automatic machines are used, comprising:

- a station for feeding a continuous strip of packaging material along a feed direction;
- a cutting station configured for separating single sheets from the continuous strip;
- a station for folding the single U-shaped sheet comprising a folding device and a first carousel, rotating about a first axis of rotation, equipped with radial grippers configured to each receive a corresponding sheet folded in a "U" shape and in such a way as to keep the closed bottom of the "U" of the individual sheet embedded towards the inside;
- a unit for sealing the two lateral edges of the sheet folded into a "U" shape; the sealing unit being positioned along the rotary path of the first carousel;
- a second carousel, rotating about a second axis, equipped with a plurality of radial grippers configured to receive, each, the sheet folded in a "U" shape and sealed at the sides; the sheet is positioned on the corresponding gripper with its open end or mouth towards the outside of the gripper; the second carousel rotates about the second axis to define an arc-shaped path for each gripper so as to allow the reaching of a series of further stations in succession, that is to say:
- a station for dosing at least one infusion product fed through the open mouth of the U-shaped sheet comprising at least one dosing device;
- a station for closing, by sealing, the mouth of the sheet;
- a station for cutting excess material present between the sealing line and the free end of the sheet or bag thus formed using a cutting element;
- a station for collecting formed bags.

It should be noted that there may be two stations for sealing the sheet one after another. The first station performs an ultrasonic sealing using a unit comprising a sonotrode, whilst the second station performs a thermal sealing, superposed on the first sealing, in order to guarantee a secure closing line.

Moreover, at least the group of stations positioned close to the second carousel and the second carousel itself are arranged in a closed space and in a controlled atmosphere or environment (through the presence of nitrogen) to maintain a high level of the integrity of the product inserted in the sheets and in such a way as to increase the times for integrity of the bags themselves, since they will have a predetermined quantity of nitrogen inside them.

The dosing station, of particular interest in this specification, comprises a device for dosing the product positioned above the second carousel in such a way as to allow the falling of a dose of product inside each individual bag in transit and retained by a corresponding gripper configured to keep the bag with the mouth in the open position.

The dosing device is provided with a product discharge channel.

Currently, one of the greatest market needs for the type of product packaged in these bags is that of being able to mix a primary product and a secondary product (for example aromatising or complementary to the primary product).

However, for this type of need the current individual dosing devices used in these machines do not have the technical characteristics for being able to mix the two products before dosing, which usually have different grain sizes per dose.

Moreover, the dimensions of the machine in the dosing zone do not allow different release points for two different products along the path of the second carousel.

AIM OF THE INVENTION

The aim of the invention is to provide a machine for forming bags with infusion or extraction products which overcomes the above-mentioned drawbacks of the prior art.

More specifically, the aim of this invention is to provide a machine for forming bags for infusion or extraction products which can increase the production quality of the bags and the productivity of the machine through greater flexibility of the dosing station.

A further aim of the invention is to provide a machine for forming bags with infusion or extraction products which is able to maintain high production speeds, however extending the operating possibilities and the type of products being formed.

Said aims are fully achieved by the machine for forming bags with infusion or extraction products according to the invention, as characterised in the appended claims.

BRIEF DESCRIPTION OF THE DRAWINGS

These and other features of the invention will become more apparent from the following detailed description of a preferred, non-limiting embodiment of it, with reference to the accompanying drawings, in which.

DETAILED DESCRIPTION OF PREFERRED EMBODIMENTS OF THE INVENTION

Figure 1:
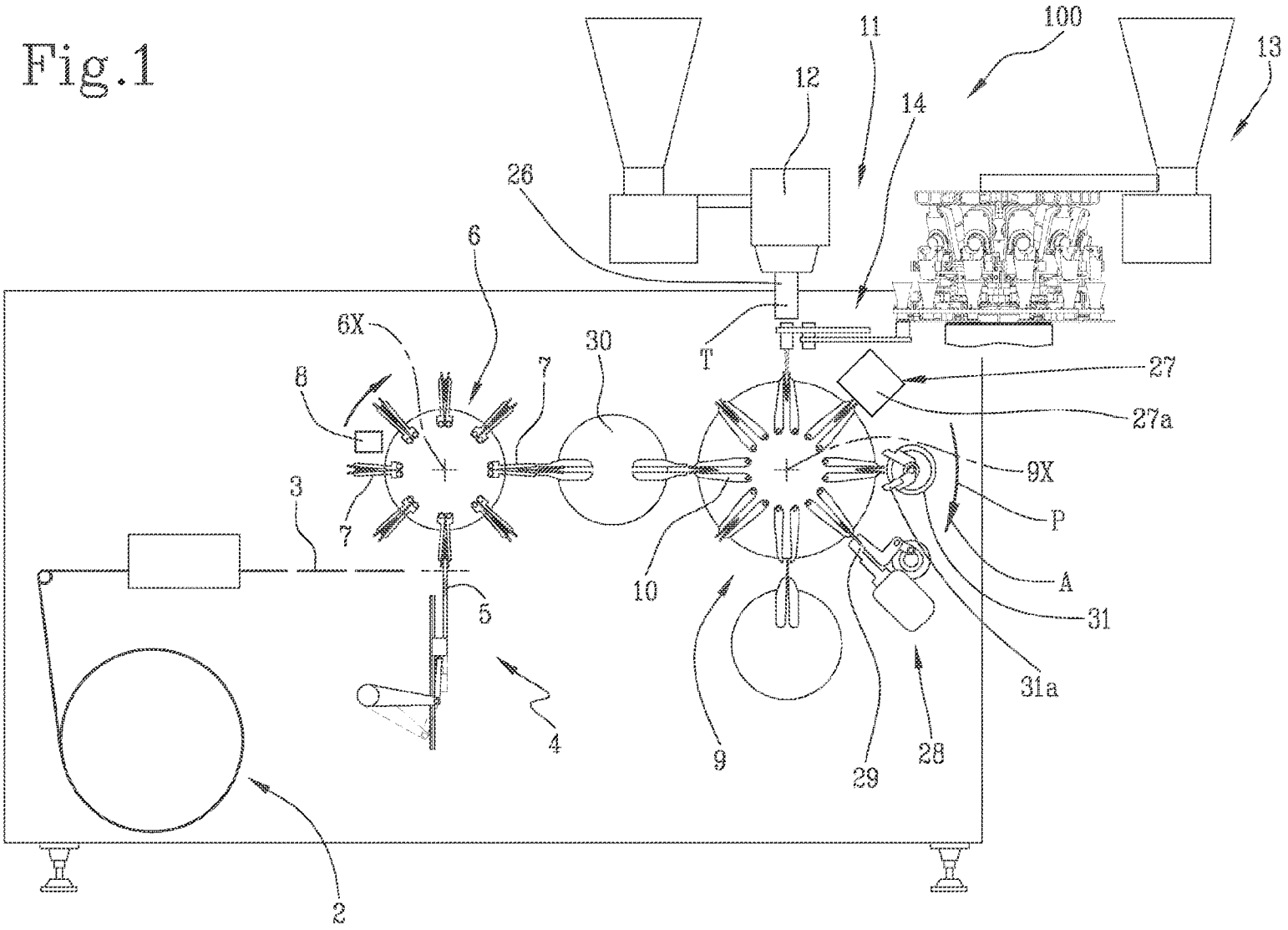
FIG. 1 is a schematic front view, with some parts cut away to better illustrate others, of a machine for forming bags with infusion or extraction products according to the invention.

With reference to the accompanying drawings, and in particular with reference to FIG. 1, the machine according to the invention, labelled 100 in its entirety, is used for forming bags 1 containing infusion or extraction products.

These bags 1 are made from single sheets of wrapping material obtained from metal films, such as, for example, aluminium, or from different material even if they have similar properties to metal films.

As illustrated, the machine 100 comprises a station 2 for forming and feeding single sheets 3 of wrapping material.

Again as illustrated, the machine 100 comprises a station 4 for U-shaped folding of the single sheet 3 comprising a folding device 5 and a first carousel 6, rotating about a first axis 6X of rotation.

The first carousel 6 is equipped with a plurality of radial grippers 7 configured to each receive a corresponding single sheet 3.

The machine 100 also comprises a unit 8 for sealing the two lateral edges of the single sheet 3 positioned in the corresponding gripper 7 in such a way as to obtain a bag 1 with a closed bottom by folding, two opposite sides closed by sealing and an open end or opening 3*d*, opposite the closed bottom.

Again as illustrated, the machine 100 comprises a second carousel 9, rotating about a second axis 9X of rotation, equipped with a plurality of radial grippers 10 configured to each receive the bag 1.

The bag 1 is positioned on the corresponding gripper 10 with its open end or opening 3*d* facing towards the outside of the gripper 10.

As illustrated, the second carousel 9 rotates about the second axis 9X to define a circular path P for each gripper 10 so as to allow a series of further stations to be reached in succession and along a feed direction A.

The stations reached by the grippers 10 are the following, along the feed direction A.

A dosing station 11 comprising at least one device 12 for dosing an infusion or extraction product fed by gravity, along a dosing trajectory T, towards the open opening 3*d* of the single sheet (see also FIG. 2); fed through the open opening 3*d* of the bag 1.

A first station 27 for closing the opening 3*d* of the bag 1 protruding from the gripper 10, by means of a transversal sealing line L.

A station 28 for cutting an edge of excess material present between the transversal sealing line and the free end of the bag 1 formed in this way using a cutting element 29 positioned radially relative to the second axis 9X of rotation of the second carousel 9.

The above-mentioned unit 8 for sealing the sides of the sheet 3 may be, in a first embodiment, along the path of the first carousel 6 and close to the first carousel 6 or, in a second embodiment, again along the path of the first carousel 6, but inserted directly on the carousel 6.

The second embodiment of the sealing unit 8 may comprise one or more sealing units positioned on each of the plurality of first radial grippers 7 present on the first rotary carousel 6. In this way, the transport times can also be used for sealing the sides of each sheet 3 directly on each first gripper 7.

Preferably, the machine 100 also comprises an intermediate carousel 30 for the passage of the individual sheets 3 from the first carousel 6 (after the lateral folding and sealing of the individual sheet 3) to the second carousel 9.

Preferable, the machine 100 comprises a second closing station 31 interposed between the first closing station 27 and the cutting station 28.

In light of this, the first closing station 27 comprises an ultrasonic sealing unit 27*a* to form the transversal closing line L of the bag 1.

The second closing station 31 comprises a hot thermal sealing unit 31*a* to form a transversal sealing strip superposed on the transversal closing line L of the bag 1.

Figure 2:
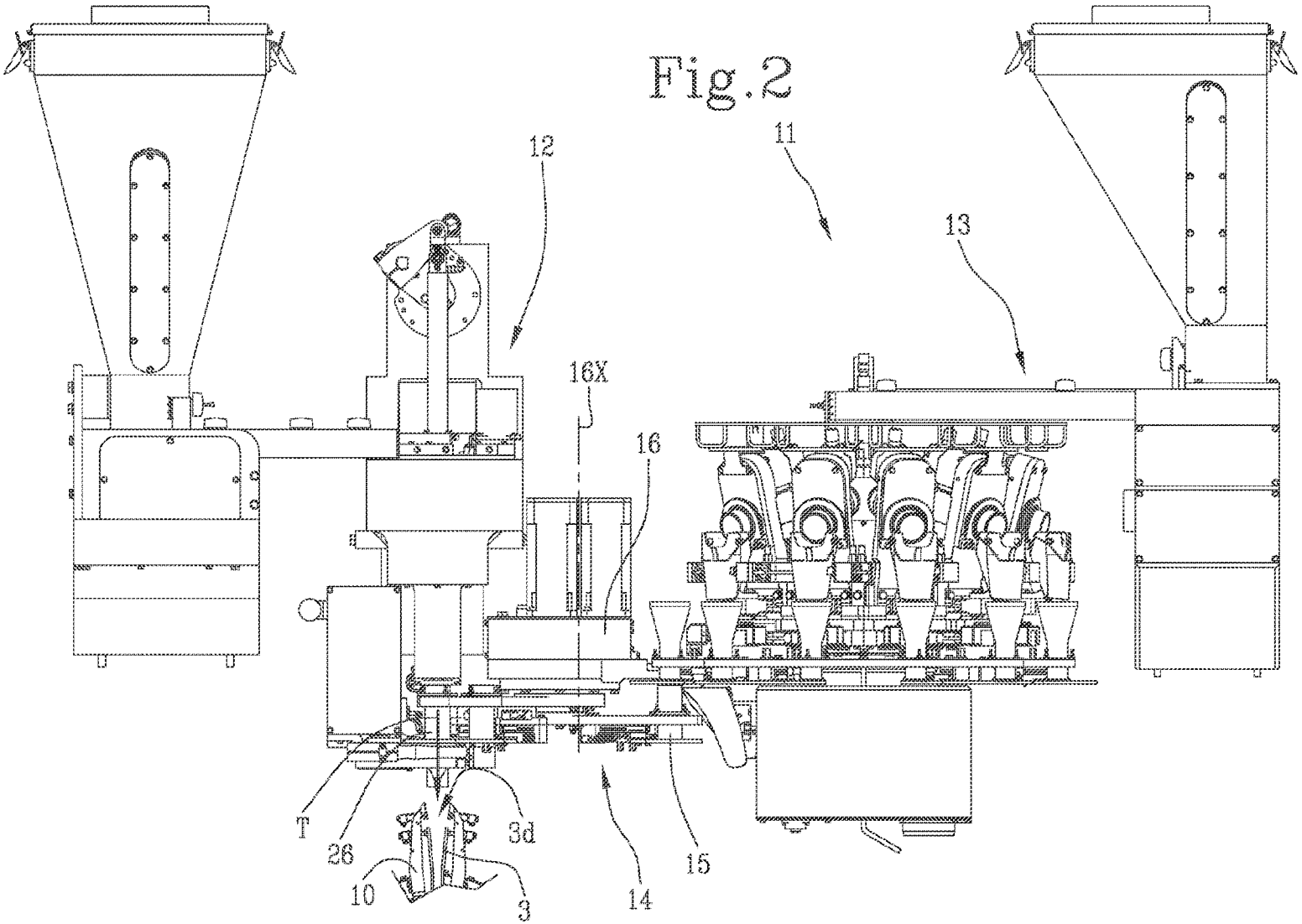
FIG. 2 is a front view of an enlarged detail of FIG. 1, in particular a station for dosing infusion or extraction products.
Figure 3:
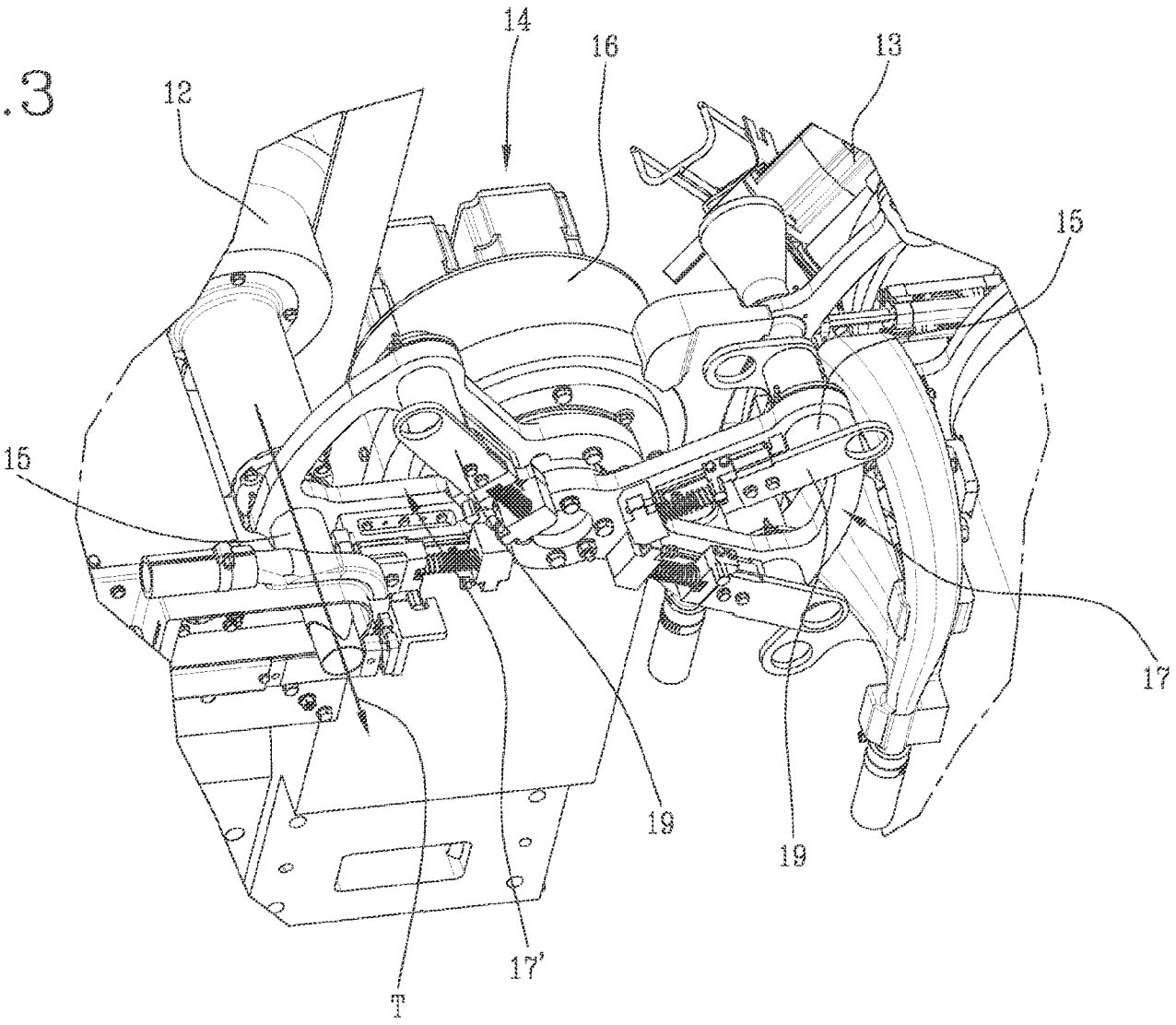
FIG. 3 is a perspective view from below of an enlarged detail of the dosing station of FIG. 2.

As illustrated in FIGS. 2 and 3, the dosing 11 comprises a second dosing device 13, positioned alongside the first dosing device 12, configured for preparing a dose of a second infusion or extraction product.

Again as illustrated, the dosing station 11 comprises a transporting element 14 positioned between the first 12 and the second 13 dosing device and having at least one container 15 for receiving the dose of the second infusion product from the second dosing device 13.

The transporting element 14 is configured to move the container 15 from a position for loading the dose of the second product to a position for unloading the second product into a zone coinciding with the dosing trajectory T from where the container 15 discharges the dose of the second product into the bag 1.

Thanks to this structure it is possible to operate quickly and easily to prepare bags with different products (both equal and different in terms of grain size) without the products entering into contact before dosing in the bag.

Preferably, the dosing devices are of a different types, for example a device may operate with gravimetric or weight dosing, whilst the other may be with volumetric type dosing: in this way, various types of products can be used in combination or individually according to production requirements.

Preferably, the transporting element 14 comprises a shaft 16 rotating about an axis 16X transversal to the above-mentioned second axis 9*x* of rotation of the second carousel 9 and at least one arm 17, integral with the rotary shaft 16, and supporting the container 15.

In light of this, the supporting arm 17 is rigid and integral with the rotary shaft 16 in such a way as to extend along a plane perpendicular to the axis 16X of rotation of the shaft 16.

It should be noted that the arm 17 has, at a relative free end, the container 15 for housing the dose of the second product in such a way as to allow, during the rotation of the shaft 16, the movement of the container 15 from a loading position where it receives the dose of the second product, when the container 15 is located beneath a zone for receiving the dose from the second dosing device 13, to a position for discharging the dose of the second product received, when the container 15 is interposed between the first dosing device 12 and the mouth 3*d* of the bag 1*i* line with the dosing trajectory T, and vice versa.

The container 15 has a preferred cylindrical shape.

Preferably, (see FIG. 3), the transporting element 14 comprises at least one pair of arms 17, 17' which are angularly spaced from each other.

In light of this, each arm 17, 17' is equipped, at its free end, with a corresponding container 15 in such a way as to allow, when required, the positioning, simultaneously, of the container 15 positioned in the zone for loading/receiving the second product and the container 15 of the other arm 17 or 17' located in the position for discharging the dose of the second product in the bag 1.

According to a preferred, non-limiting embodiment of the invention, the transporting element 14 comprises two pairs of arms 17, 17', angularly spaced from each other.

Each pair of arms 17, 17' being integral with each other and angularly spaced from each other to form a "V" with joining vertex at the axis 16X of rotation of the rotary shaft 16.

This solution allows a large rotation of the shaft each two doses and makes the entire transporting element more balanced during the rotations.

Figure 4:
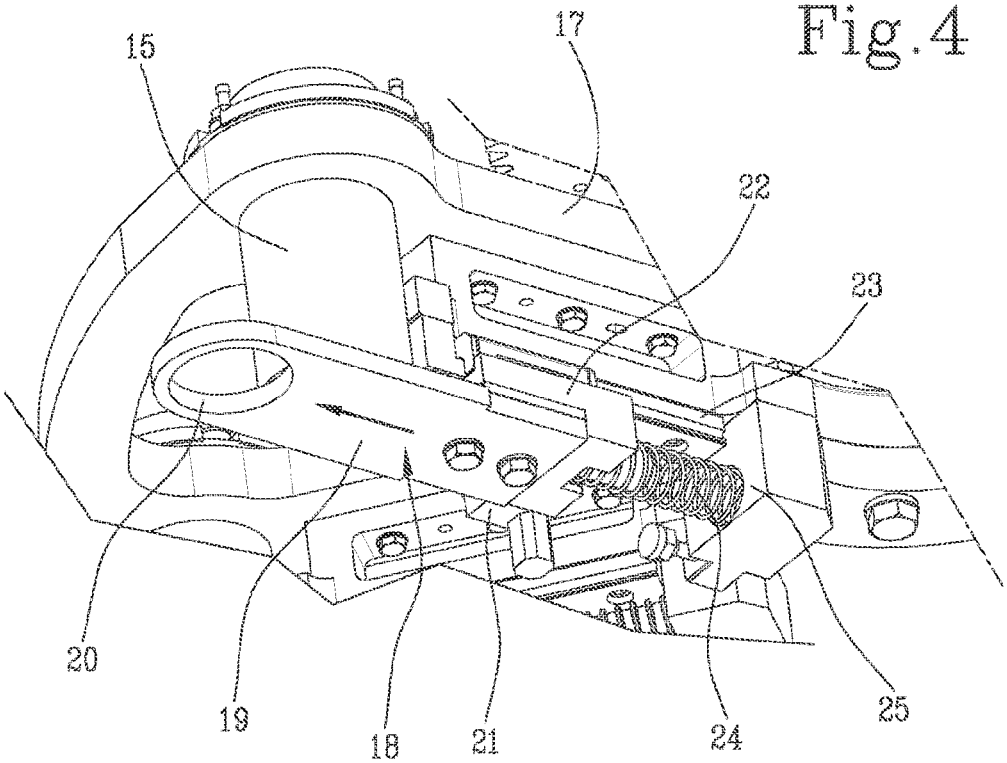
FIGS. 4 and 5 are perspective views from below of the dosing station of FIG. 3 in two different operating configurations.
Figure 5:
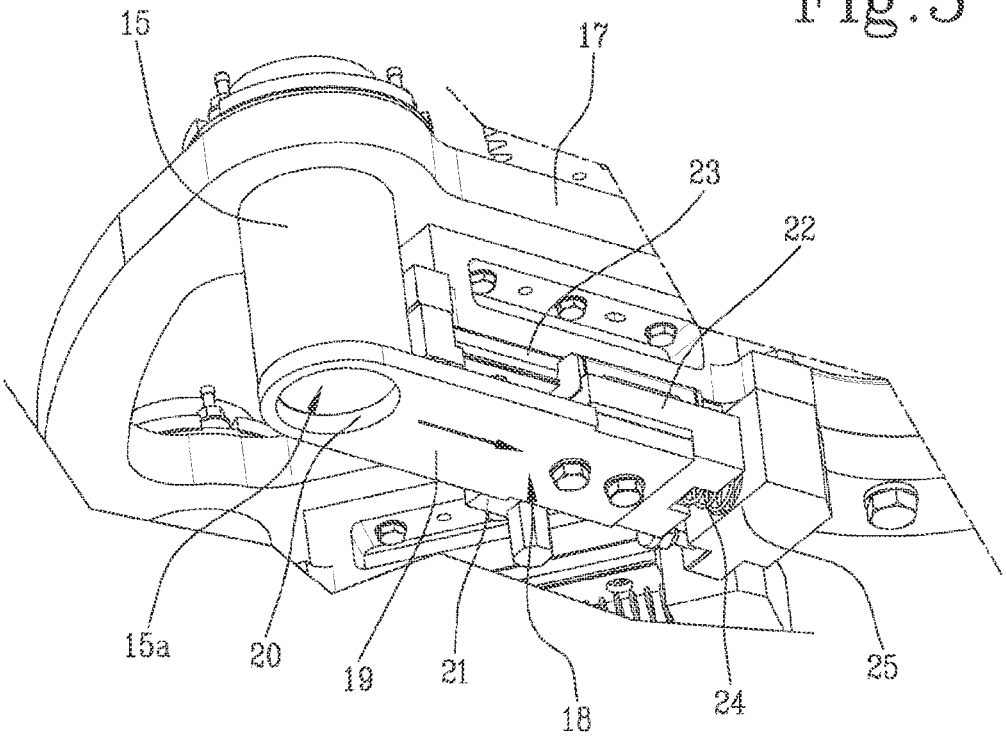

Preferably, each container 15 has an open bottom 15*a* (circular in shape) engaged by a selection device 18 configured for opening or closing the bottom 15*a* as a function of the positions adopted by the container 15 (see FIGS. 4 and 5).

In light of this, the selection device 18 may be of the guillotine type (only as a non-limiting embodiment) and comprises a plate 19 slidable, in both directions, parallel to the extension of the arm 17, 17' and having an opening 20 close to its first end (in this case the opening is circular in shape to coincide with the circular bottom 15*a* of the container 15).

The selection device 18 comprises a control element 21 associated with the slidable plate 19 and configured for moving the slidable plate 19 from a closed position of the bottom 15*a* of the container 15 (FIG. 4), wherein a portion of full surface of the plate 19 engages the bottom 15*a* of the container 15, to an open position of the bottom 15*a* of the container 15 (FIG. 5), wherein the opening 20 of the plate 19 coincides with the open bottom 15*a* of the container 15 to allow the passage of the dose of the second product.

It should be noted that the plate 19 is equipped with a slide 22 connected to a guide 23 integral with the arm 17, 17' in such a way as to allow the plate 19 to slide between an open position and a closed position of the base 15*a* of the container 15.

Preferably, the selection device 18 comprises an elastic element 24 (for example a spring), interposed between a second end of the plate 19 and a protruding contact surface 25 of the arm 17, 17', and configured for returning the plate 19 to the closed position of the bottom 15*a* of the container 15 at the deactivation of the control element 21.

This structure allows the use of a simplified single-phase actuator to obtain an arm which, as a whole, is light and without excessive vibrations or bending.

It should be noted that the container 15, located in the discharging position for discharging the second product in the zone coinciding with the dosing trajectory T, defines an extension of an outfeed terminal 26 of the first dosing device 12.

This positioning of the container 15 makes it possible to always have precise dosing of both products (when necessary) and also the possibility in any case of dosing a single product (again using the first dosing device), which slides through the container 15 (with the plate 19 in the open condition).

The machine structured in this way achieves the preset aims thanks to the dosing station equipped with two separate dosing devices which are positioned side by side, but independent in their functions for preparing the corresponding dose.

The presence of the transporting element makes it possible to have a single dosing point for both the doses in such a way as to reduce the overall dimensions of the machine with an increase in the operating flexibility of the machine which is able to produce bags with single or double product.

The invention claimed is:

1. A machine for forming bags with infusion or extraction products, the machine comprising at least:

a station for forming and feeding single sheets of wrapping material;

a station for U-shaped folding of the single sheets, comprising a folding device and a first carousel rotating about a first axis of rotation, the first carousel including a plurality of first radial grippers each configured to receive a corresponding single sheet;

a unit for sealing two lateral edges of the single sheet positioned in a corresponding first radial gripper, to create a bag with a closed bottom formed by folding, two opposite sides closed by sealing and an open mouth opposite the bottom;

a second carousel, rotating about a second axis of rotation, the second carousel including a plurality of second radial grippers each configured to receive the bag which has been created, said bag being positioned on a corresponding second radial gripper with the open mouth facing towards an outside of the second carousel, the second carousel rotating about the second axis moving each second radial gripper along a path passing through at least one dosing station having a first dosing device configured for feeding by gravity a first infusion or extraction product along a dosing trajectory into the open mouth of the bag;

wherein the at least one dosing station further comprises:

a second dosing device configured for preparing a dose of a second infusion or extraction product;

a transporting element positioned between the first dosing device and the second dosing device and having at least one container for receiving the dose of the second infusion or extraction product from the second dosing device, said transporting element being configured to move the at least one container from a position for loading the dose of the second infusion or extraction product to a position for unloading the second infusion or extraction product at a zone which coincides with the dosing trajectory and from where the at least one container discharges the dose of the second infusion or extraction product in the bag.

2. The machine according to claim 1, wherein the transporting element comprises: a shaft rotating about a third axis of rotation transversal to said second axis of rotation of the second carousel, and at least one supporting arm coupled with the shaft and supporting the at least one container.

3. The machine according to claim 2, wherein the at least one supporting arm extends along a plane perpendicular to the third axis of rotation of the shaft, the at least one supporting arm moving the at least one container to a free end thereof, to allow, during the rotation of the shaft, movement of the at least one container from a loading position in which the at least one container receives the dose of the second infusion or extraction product while being located beneath the second dosing device, to an unloading position for discharging the dose of the second infusion or extraction product, in which position the at least one container is positioned between the first dosing device and the open mouth of the bag in line with the dosing trajectory.

4. The machine according to claim 3, wherein the at least one supporting arm comprises at least one pair of arms angularly spaced from each other, each arm carrying a respective container at a free end thereof to allow, during the rotation of the shaft, simultaneous positioning of the container of an arm of the pair of arms positioned in the loading position and of the container of the other arm of the pair of arms positioned in the unloading position.

5. The machine according to claim 3, wherein the at least one supporting arm comprises two pairs of arms angularly spaced from each other, the arms of each pair of arms being integral with each other and angularly spaced from each other to form a "V" with a vertex at the third axis of rotation of the shaft.

6. The machine according to claim 2, wherein the at least one container has an open bottom coupled to a selection device configured for opening or closing the bottom of the at least one container as a function of the position of the at least one container.

7. The machine according to claim 6, wherein the selection device comprises a plate slidable, in both directions, parallel to an extension of the at least one supporting arm and having an opening at a first end thereof, a control element being associated with the plate and configured for moving the plate from a closed position in which the bottom of the at least one container is closed to an open position in which the bottom of the at least one container is open, wherein a portion of a full surface of the plate closes the bottom of the at least one container, and wherein the opening of the plate aligns with the open bottom of the at least one container to allow escape of the dose of the second infusion or extraction product.

8. The machine according to claim 7, wherein the plate includes a slide connected to a guide integral with the at least one supporting arm to allow the plate to slide between the open position and the closed position.

9. The machine according to claim 7, further comprising an elastic element interposed between a second end of the plate opposite the first end and a protruding contact surface of the at least one supporting arm, said elastic element being configured to push the plate to the closed position at deactivation of the control element.

10. The machine according to claim 1, wherein when the at least one container is located in the position for unloading the second infusion or extraction product, the at least one container encounters an extension of an outfeed terminal of the first dosing device.

* * * * *